US007565293B1

(12) United States Patent
Fuhrmann et al.

(10) Patent No.: US 7,565,293 B1
(45) Date of Patent: Jul. 21, 2009

(54) SEAMLESS HYBRID COMPUTER HUMAN CALL SERVICE

(75) Inventors: Oded Fuhrmann, Zichron Yaakov (IL); Ron Hoory, Haifa (IL); Dan Pelleg, Haifa (IL)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/116,575

(22) Filed: May 7, 2008

(51) Int. Cl.
*G10L 13/08* (2006.01)

(52) U.S. Cl. ..... 704/260; 704/258; 704/266; 704/270; 704/270.1

(58) Field of Classification Search ..... 704/260, 704/258, 266, 270, 270.1
See application file for complete search history.

(56) References Cited

U.S. PATENT DOCUMENTS

| | | | | |
|---|---|---|---|---|
| 6,081,780 | A | 6/2000 | Lumelsky | |
| 6,614,885 | B2 | 9/2003 | Polcyn | |
| 6,771,746 | B2 | 8/2004 | Shambaugh et al. | |
| 7,275,032 | B2 | 9/2007 | Macleod | |
| 2002/0087323 | A1 | 7/2002 | Thomas et al. | |
| 2002/0152071 | A1 | 10/2002 | Chaiken et al. | |
| 2003/0028380 | A1 * | 2/2003 | Freeland et al. | 704/260 |
| 2004/0176957 | A1 * | 9/2004 | Reich | 704/260 |
| 2008/0065383 | A1 * | 3/2008 | Schroeter | 704/260 |

OTHER PUBLICATIONS

Federica Cena and Ilaria Torre, "Adaptive Management of the Answering Process for a Call Center System," Department of Computer Sciences, University of Torino, Italy, (2003).

* cited by examiner

*Primary Examiner*—Qi Han
(74) *Attorney, Agent, or Firm*—Connolly Bove Lodge & Hutz LLP; Robert M. Trepp, Esq.

(57) ABSTRACT

A Voice User Interface is provided for interactively responding in a synthesized voice to a call from a human caller, a Text to Speech system by which text entered by an agent and interactive data are converted to synthesized speech, a morphing transformation library containing pre-computed voice transformation parameters unique to each agent affiliated with the VUI, and a switching system for transferring handling of the call between the VUI and the agent. The human agent's verbal interaction with the caller is performed in the agent's natural voice. Text transmitted by an agent to a caller and interactive data is in a synthesized voice created using the pre-computed transformation parameters corresponding to the agent's ID selected from the morphing transformation library. All speech presented to a caller is presented in approximately the same unique voice as initially presented when the call is established, thereby permitting an aurally seamless phone call, as perceived by the caller.

1 Claim, 3 Drawing Sheets

SEAMLESS HYBRID COMPUTER HUMAN CALL SERVICE

BACKGROUND

The present invention relates to a method and system for providing voice services. Automated Voice User Interfaces (VUI's) use voice synthesis technology to converse with a caller in a dialogue. Callers become used to this synthesized voice in the dialogue. In many instances however, it is necessary to transfer the call to a human agent if a caller's needs cannot be met by the VUI. Invariably, the voice that a caller hears when linked to the VUI is quite different from the sound of the human voice when the caller is transferred to an agent. Sometimes a caller alternates between the VUI and an agent during a single call depending on their needs. When this occurs the different voices that result from alternating between the VUI and an agent can be annoying and confusing.

In another scenario, there are occasions when a caller is in conversation with a human agent and is subsequently transferred to a computer system to continue the call. Once the caller is transferred to the computer system, information is related to the caller in a synthesized voice that sounds quite different to that of the human agent that the caller originally spoke to which can also be irritating to the caller. It is desirable, therefore, to have a system wherein the voice heard by a caller is consistent whether the caller is interacting with a human agent or a VUI and whereby switching between the two appears seamless to the caller.

SUMMARY

The invention is directed to a VUI that communicates in the same voice through all phases of a telephone call with a caller regardless of whether the caller is first communicating with a human agent and switched to a text to speech system and vice-versa. In an embodiment, the invention is a method of providing a seamless hybrid computer and human call service comprising interacting during a telephone call with at least one of a human agent and a Voice User Interface, the Voice User Interface comprising a Text to Speech (TTS) system by which one of text entered by the agent and computer generated text is converted to speech and transmitted to the human caller; a morphing transformation library containing pre-computed voice parameters unique to agents affiliated with the Voice User Interface; and a switching subsystem for transferring handling of the call between the Voice User Interface and the human agent and wherein when a call is initially handled by verbal interaction with the human agent, the agent's natural voice is heard by the caller and wherein when the call is transferred from the human agent to the Voice User Interface, the text to speech system communicates agent entered text or computer generated interactive data to the caller in a synthesized voice using pre-computed voice transformation parameters unique to the agent who transferred the call and thereby rendering the voice derived from the text to speech system similar to the agent's natural voice and wherein when a call is initially handled by the Voice User Interface, the text to speech system communicates with the caller in a synthesized voice and When the call is transferred to an agent, an agent to computer transformation is applied to the agent's voice using the pre-computed parameters according to the agent ID in the morphing transformation library thereby rendering the agent's voice similar to that initially perceived by the caller.

DETAILED DESCRIPTION

The present invention performs a morphing transformation in specific instances to either modify the sound of a particular human's voice to make it sound like the voice of a computer that forms part of a VUI system, or make the computer voice sound like the human. There are various techniques that can be applied to morph one voice into another. Morphing can be accomplished by a simple linear pitch shift and format shift for example. Morphing techniques can be applied to the human agent's speech or to the TTS output in a VUI to create a sound that mimics the computer voice and agent's voice respectively. Alternatively the human agent can type his or her answer as text and the TTS system will convert the text to speech in the computer-generated voice.

Figure 1:
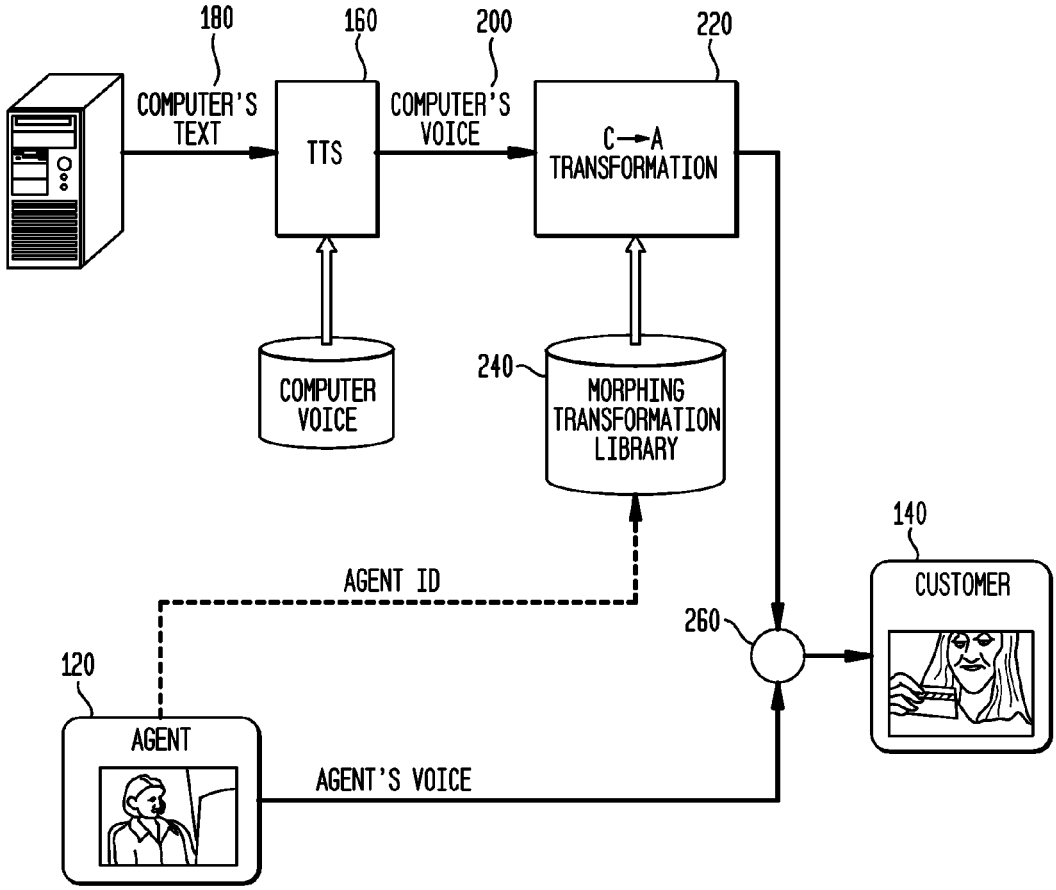
FIG. 1 is a schematic depicting a call scenario in accordance with, the present invention.

In one embodiment, there are two main scenarios for operation of the system of the invention. In the first scenario, in an established call, an agent is talking to a caller when at some point during the call, the caller is transferred to a VUI by a switching subsystem. FIG. 1 depicts this scenario. As depicted therein, the agent 120 is talking to the caller 140. After the caller 140 is transferred, a TTS system 160 is used to convert the computer text 180 to the computer voice 200. This is typically accomplished with a concatenative TTS system with a voice dataset (recorded by a voice talent). Alternatively or in addition to TTS, pre-recorded prompts recorded by a voice talent may be used (if both TTS and pre-recorded prompts are used, typically, the same voice talent is used). Computer to agent voice transformation 220 is then applied using the pre-computed transformation parameters selected from the morphing transformation library 240 according to the agent ID (and the computer voice ID if there are several of them). The resulting morphed computer voice is similar to the agent's voice, thereby rendering the switch between them seamless.

Figure 2:
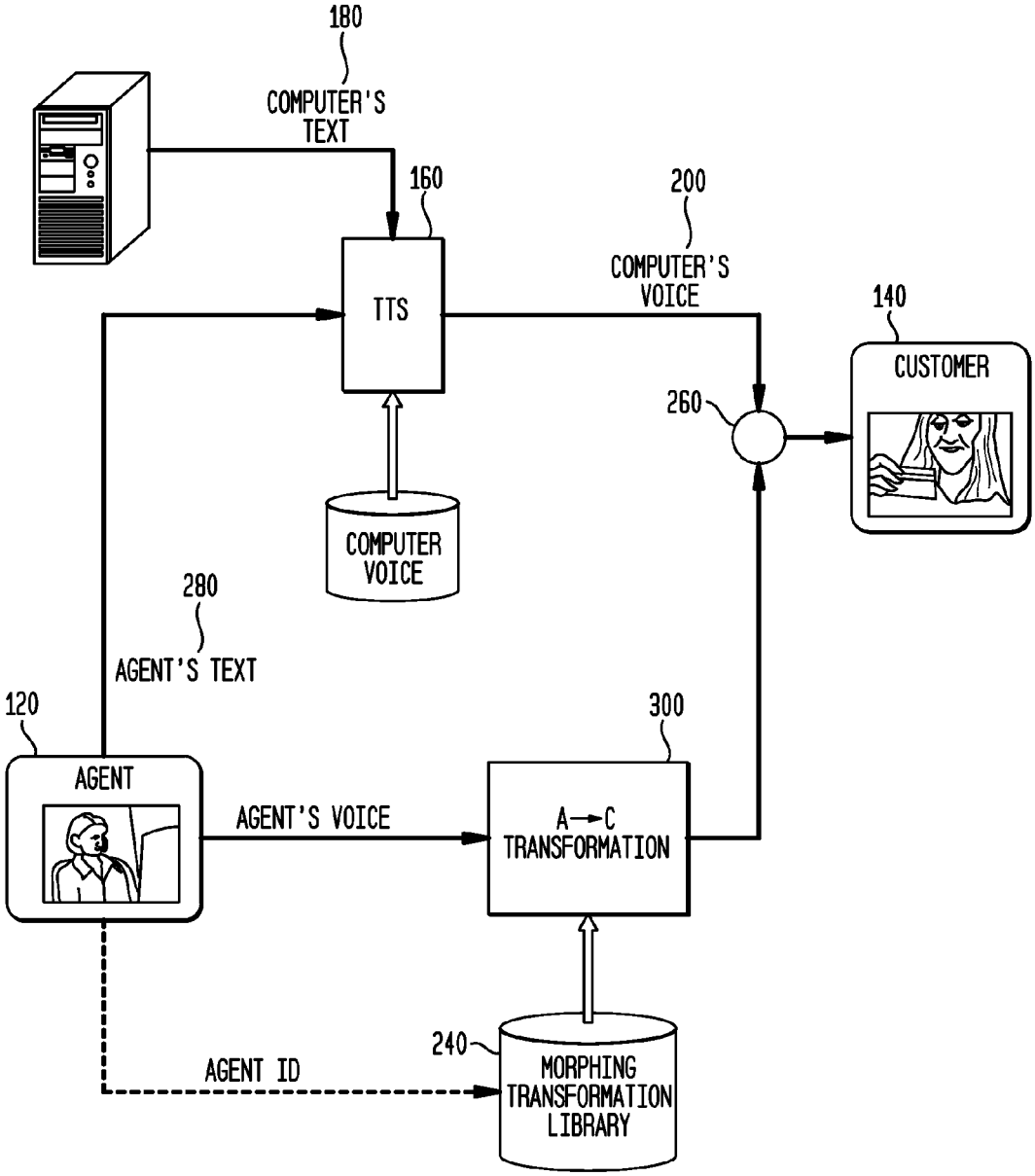
FIG. 2 is a schematic depicting another call scenario in accordance with the invention.

In the second scenario, in an established call, the caller 140 is initially communicating with a VUI and at some point the caller 140 is transferred to a human agent 120. This scenario is depicted in FIG. 2. As depicted therein, while the caller 140 is using the VUI, the caller 140 receives the computer's voice 200 from the TTS system 160. After the caller 140 is transferred to the agent 120, an agent to computer transformation 300 is applied to the agent's 120 voice using the pre-computed transformation parameters selected from the morphing transformation library 240 according to the agent ID. Alternatively, the human agent can type the answers in agent's text 280 and the TTS 160 system will synthesize speech with the computer's voice 200.

In this manner, the invention provides a VUI that communicates in the same voice through all phases of a telephone call with a caller 140 regardless of whether the caller 140 is first communicating with a human agent 120 and switched to a text to speech system 160 or vice-versa.

Figure 3:
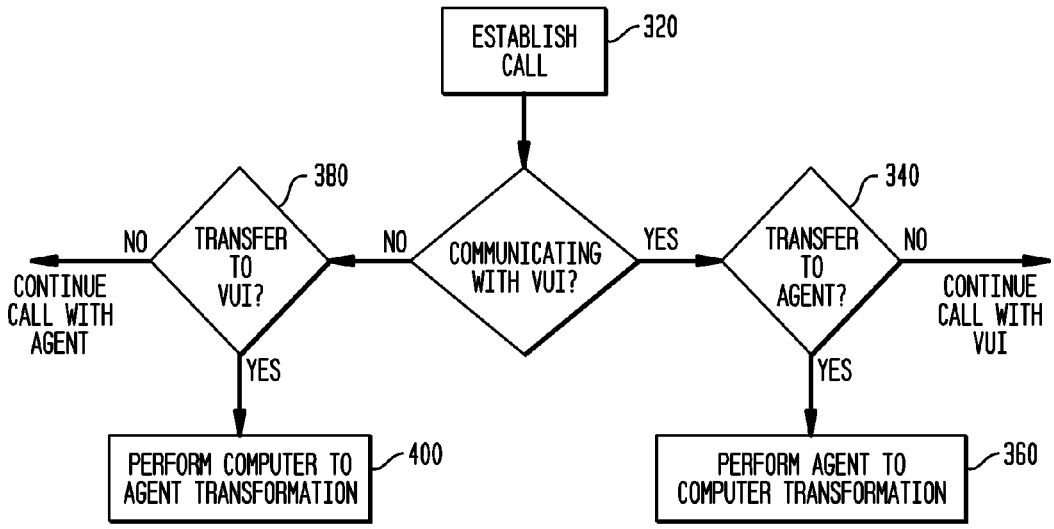
FIG. 3 is a flowchart depicting a method in accordance with the invention.

FIG. 3 depicts steps in a method in accordance with the invention. As depicted therein, a method of the invention commences with a caller establishing a call as depicted in step 320. Once a call is established, a determination is made as to whether the caller is communicating with a VUI. If yes, a transfer, if necessary, is made to an agent as depicted by step 340, Once a transfer to an agent is made in step 340, an agent to computer morphing transformation is applied as depicted in step 360. On the other hand, if a call is initially established between a caller and an agent, the method steps, would comprise a transfer to a VUI when necessary as depicted by step 380, followed by the application of a computer to agent morphing transformation as described above which is depicted as step 400.

It should be noted that the embodiment described above is presented as one of several approaches that may be used to embody the invention. It should be understood that the details presented above do not limit the scope of the invention in any way; rather, the appended claims, construed broadly, completely define the scope of the invention.

What is claimed is:

1. A method of providing a seamless hybrid computer and human call service comprising:

interacting during a telephone call by a caller with at least one of a human agent and a Voice User Interface, the Voice User Interface comprising:

a text to speech system by which one of text entered by the human agent and computer generated text is converted to speech by the text to speech system and transmitted by the caller;

a morphing transformation library containing pre-computed voice parameters unique to agents affiliated with the Voice User Interface; and a switching subsystem for transferring handling of the call between the Voice User Interface and the human agent, wherein when a call is initially handled by verbal interaction with the human agent, the agent's voice is heard by the caller, and wherein when the call is transferred from the human agent to the Voice User Interface, the text to speech system communicates an agent's text entered by the human agent or a computer's text to the caller in a computer's voice using pre-computed voice transformation parameters unique to the agent who transferred the call and thereby rendering the computer's voice derived from the text to speech system similar to the agent's voice, and wherein when a call is initially handled by the Voice User Interface, the text to speech system communicates with the caller in a computer's voice and when the call is transferred to the human agent an agent to computer transformation is applied to the agent's voice using the pre-computed parameters according to the agent ID in the morphing transformation library thereby rendering the agent's voice similar to that of the computer's voice initially perceived by the caller.

* * * * *